United States Patent [19]

Perkins

[11] 4,408,619

[45] Oct. 11, 1983

[54] VIBRATORY PNEUMATIC TOBACCO FEEDER

[75] Inventor: J. E. Steven Perkins, Colonial Heights, Va.

[73] Assignee: Philip Morris Incorporated, New York, N.Y.

[21] Appl. No.: 272,817

[22] Filed: Jun. 11, 1981

[51] Int. Cl.[3] ..... A24C 1/02

[52] U.S. Cl. ..... 131/108; 131/109 R; 131/109 AB; 131/110

[58] Field of Search ..... 131/108, 109 R, 109 AB, 131/110

[56] References Cited

U.S. PATENT DOCUMENTS

| | | | |
|---|---|---|---|
| 2,902,141 | 8/1959 | Schlossmacher | 198/106 |
| 2,948,569 | 6/1960 | Bodner | 302/28 |
| 2,983,275 | 2/1961 | Volckers | 131/21 |
| 3,070,847 | 1/1963 | Schwab | 131/109 AB |
| 3,311,114 | 1/1967 | Schlossmacher | 131/109 |
| 3,319,772 | 3/1967 | Orlandi | 198/110 |
| 3,386,773 | 5/1968 | Ballard, Jr. | 302/28 |
| 3,468,459 | 9/1969 | Bonneric | 131/109 AB |
| 3,508,791 | 3/1970 | Mizzau | 302/28 |
| 3,829,164 | 9/1974 | Schoeb | 302/28 |
| 3,863,990 | 10/1975 | Ballard, Jr. | 302/28 |
| 3,989,309 | 11/1976 | Preston | 302/13 |
| 4,050,741 | 11/1977 | Dickinson | 302/13 |
| 4,155,367 | 5/1979 | Rudsziuat et al. | 131/109 AB |
| 4,163,489 | 8/1979 | Wahl | 198/505 |
| 4,254,781 | 5/1981 | Thiele et al. | 131/109 AB |

*Primary Examiner*—V. Millin

*Attorney, Agent, or Firm*—Arthur I. Palmer; Nelson Blish

[57] ABSTRACT

Tobacco feeder (10) consists of a conveyor belt (12), vibrating collecting pan (26), and control flaps (22*a-b*, 24*a-b*). Metering tube (16) delivers tobacco to conveyor belt (12), the speed of which varies depending on the number of cigarette making machines in operation. Conveyor belt (12) deposits tobacco on vibrating collecting pan (26) which has an inclined portion (28) to cause the tobacco flow to increase in velocity, thereby decreasing in density, as tobacco moves down the inclined portion (28). Control flaps (22*a*, 22*b*, 24*a*, 24*b*) direct the flow of tobacco to vacuum tubes (18*a*, 18*b*, 18*c*, 18*d*) depending on which cigarette makers are in operation.

5 Claims, 2 Drawing Figures

VIBRATORY PNEUMATIC TOBACCO FEEDER

BACKGROUND OF THE INVENTION

This invention relates to a system for automatically feeding and conveying tobacco from one area to another and more particularly to a system for automatically feeding and conveying tobacco from a storage area to a cigarette making machine.

DESCRIPTION OF THE PRIOR ART

In cigarette manufacturing, tobacco will normally be stored or processed at a location separate from the location of the cigarette making machine. Thus, it is necessary to transport the tobacco from the storage or processing location to the cigarette making machines. This is usually done by means of pneumatic tubes which carry the tobacco on a moving air stream.

Tobacco feeders are used to distribute a measured amount of tobacco to the suction end of the pneumatic tubes. For example, a tobacco feeder disclosed by Preston, U.S. Pat. No. 3,989,309, uses a horizontal rotor drum with external rakes for picking up tobacco to transport a measured amount of tobacco to the suction end of pneumatic tubes in the top portion of the feeder housing. A disadvantage associated with a rotary drum type feeder, however, is that if some of the pneumatic tubes are not operating the tobacco on that portion of the rotary drum is recycled. This recycling can result in mechanical degradation of the tobacco, and could also result in drying of the tobacco both of which are undesirable.

Another type of feeder is a disclosed by Ballard, Jr., U.S. Pat. No. 3,386,773, which uses a conveyor belt and a rotary rake to feed a pneumatic tube located at the bottom of a chute. A problem associated with this arrangement is that chokes, or mechanical blockage of the pneumatic tube by tobacco, may occur in the lower portions of chute during changes in demand by different cigarette makers or changes in air velocity in the pneumatic tubes.

It is, therefore, an object of the present invention to provide a tobacco feeder which will supply metered quantities of tobacco to a group of pneumatic tubes for transportation to cigarette making machines without choke points associated with prior art machines.

It is also an object of the present invention to provide a tobacco feeder which will feed a variable number of cigarette makers without recirculating the tobacco when some of the cigarette makers are not in operation.

SUMMARY OF THE INVENTION

According to the present invention, the foregoing and other objects are attained by providing a tobacco feeder with a variable speed conveyor belt and programmable control flaps. A metering tube supplies a measured quantity of tobacco to the conveyor belt, the speed of which is varied in accordance with the number of cigarette making machines being supplied. The variable speed conveyor delivers the tobacco to a vibrating collecting pan, a portion of which is inclined to accelerate the flow of tobacco. Control flaps direct the moving tobacco to the suction end of those pneumatic tubes which are in operation. The pneumatic tubes are located above the moving bed of tobacco in order to minimize possibility of choke.

BRIEF DESCRIPTION OF THE DRAWINGS

A more complete appreciation of the invention and many of the attendent advantages thereof will be readily apparent by reference to the following detailed description when considered in connection with the accompanying drawings wherein.

DESCRIPTION OF THE PREFERRED EMBODIMENT

Figure 1:
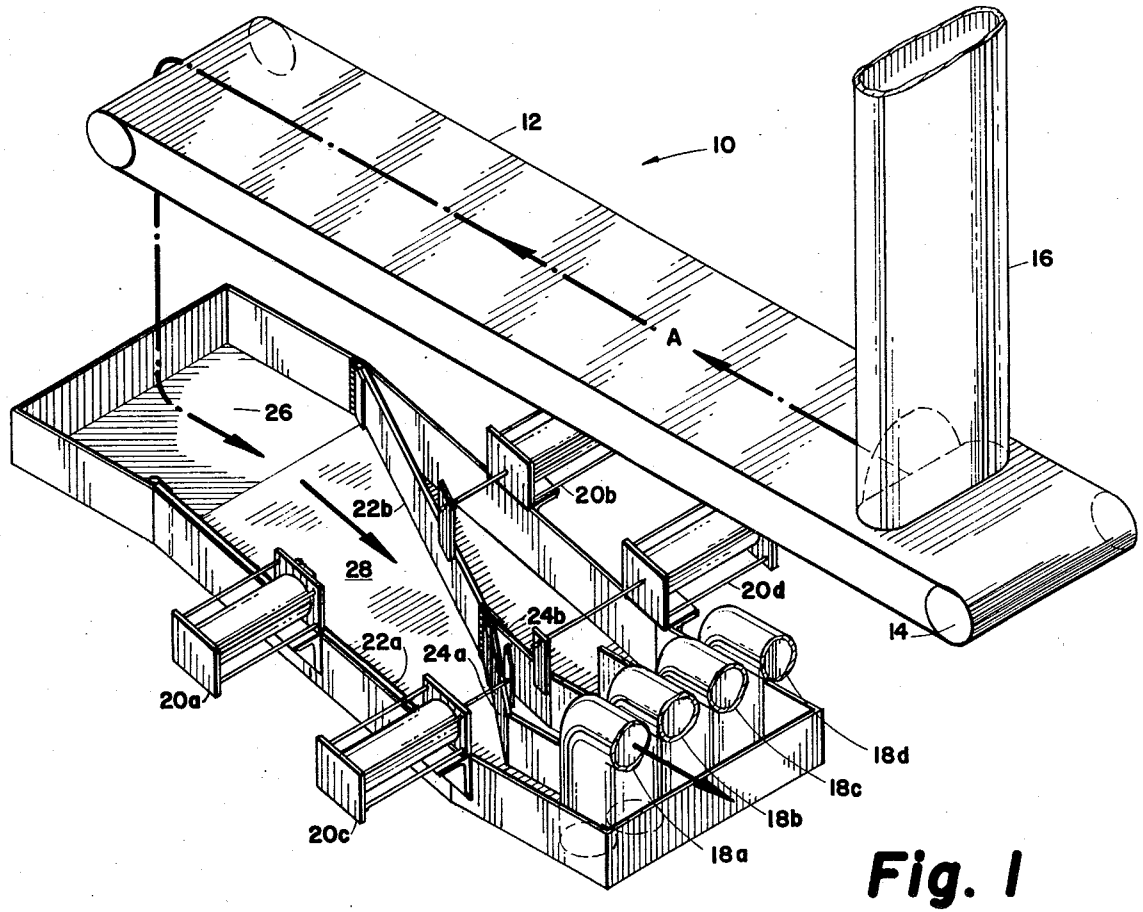
FIG. 1 is a prespective view of a tobacco feeder according to the present invention wherein only one pneumatic tube is being supplied.

Referring now particularly to the drawings and specifically to FIG. 1, there is illustrated a preferred embodiment of the invention as it would be used in a tobacco feeder capable of supplying four cigarette making machines and designated generally by the number 10.

Tobacco is supplied to feeder 10 by metering tube 16. Tobacco from metering tube 16 is deposited on conveyor 12 which moves in the direction indicated by the arrow A. The speed of conveyor 12 may be varied depending on the number of cigarette making machines that are running. FIG. 1 indicates the condition of the feeder when only one cigarette making machine requires tobacco. Thus, conveyor belt 12 will be running at its lowest speed supplying tobacco for one cigarette maker. If two cigarette making machines were operating, conveyor 12 would run at a speed 2 which would be twice the speed of speed one.

Conveyor belt 12 deposits tobacco on collecting pan 12, which vibrates in order to cause the tobacco to slide more easily. A portion of collecting pan 26 is inclined 28 so that the moving bed of tobacco will increase in velocity under the force of gravity and thus decrease in density.

The moving stream of tobacco may be directed to all or any pneumatic tubes 18*a–d* by control flaps 22*a*, 22*b*, 24*a*, 24*b*. In FIG. 1, control flap 22*a* is positioned against the wall of collecting pan 26 and control flap 24*a* is positioned so that it blocks tobacco flow to tube 18*b*. Control flap 22*b* is positioned to block tobacco flow to tubes 18*c* and 18*d*. Thus the entire stream of tobacco will be directed to pneumatic tube 18*a* which is the only one operating in FIG. 1. Since conveyor belt 12 is operating at speed one, the optimum amount of tobacco for one cigarette maker is being supplied to pneumatic tube 18*a*.

Control flaps 22*a*, 22*b*, 24*a*, 24*b* are positioned by means of air operated cylinders 20*a*, 20*b*, 20*c*, 20*d*. FIG. 1 shows air cylinders 20*a* and 20*c* in the fully retracted position, and air cylinders 20*b* and 20*d* in the fully extended position, to position control flaps as described above.

In operation, tobacco from metering tube 16 is transported by conveyor belt 12 to vibrating collecting pan 26. Tobacco deposited on collecting pan 26 is accelerated down inclined portion 28 by gravity and the flow of air to pneumatic tube 18*a*. Flaps 22*a*, 22*b*, and 24*a* guide the moving bed of tobacco to the suction end of pneumatic tube 18*a*. Pneumatic tube 18*a* is positioned so that the suction portion of the tube is above the moving bed of tobacco. Thus, if there is a loss of vacuum, the tobacco would be left in the bed of collecting pan 26 rather than accumulating in the pneumatic tube as would be the case if the suction of the pneumatic tube were located at a position lower than the collecting pan. Also, since only the amount of tobacco necessary to supply the number of machines operating is supplied by variable speed conveyor belt 12, there is no tobacco accumulation in pan 26, and no drying of the tobacco occurs. Since this type tobacco does not have recirculation, tobacco breakage is minimized.

Figure 2:
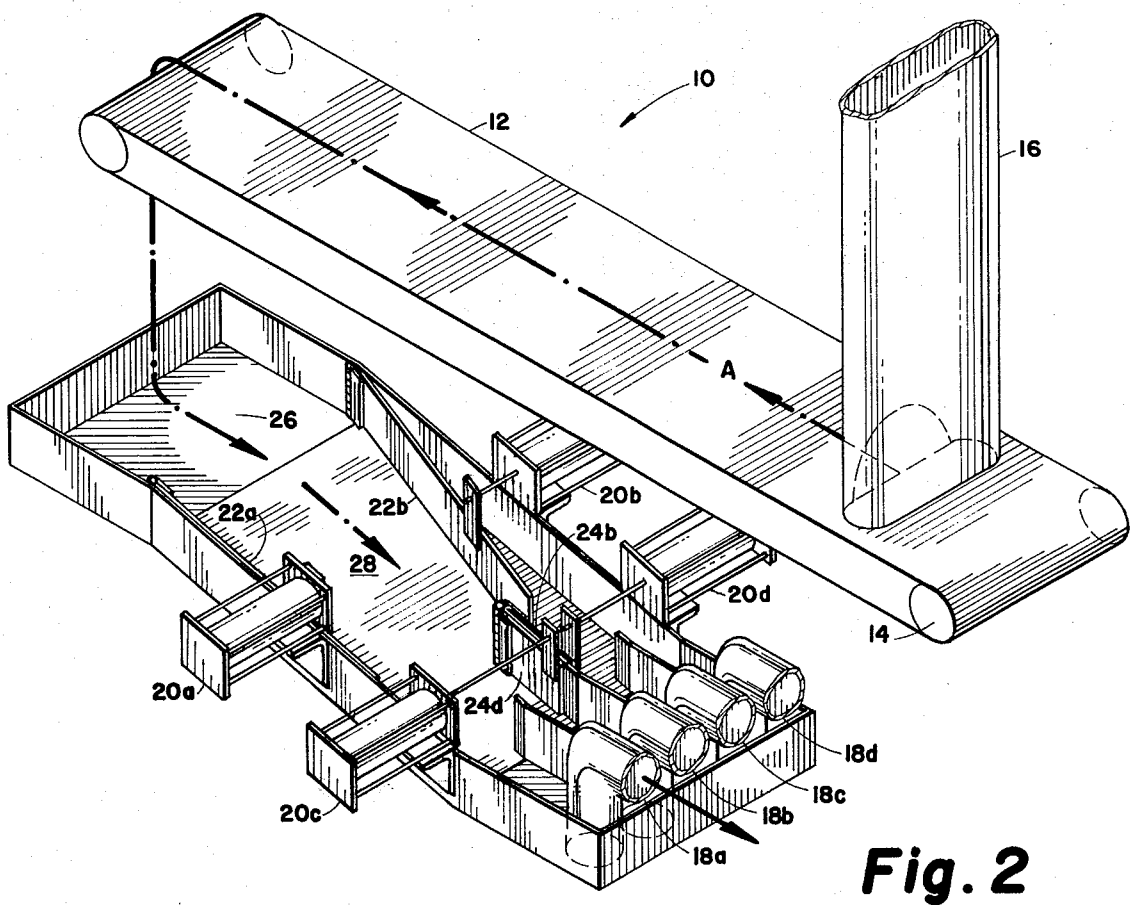
FIG. 2 is prespective view of the invention shown in FIG. 1 wherein three of the four pneumatic tubes are in operation.

Referring now to FIG. 2, tobacco feeder 10 is shown supplying three cigarette making machines. Conveyor belt 12 will be operating at a speed sufficient to transport the amount of tobacco necessary to supply three cigarette making machines approximately three times the speed of conveyor belt 12 when supplying one cigarette making machine. Air operated cylinders 20*c* and 20*d* are in fully extended positions thereby positioning flaps 24*a* and 24*b* to direct tobacco to pneumatic tubes 18*b* and 18*c*. Air operated cylinder 20*a* is in the fully retracted position. Holding flap 22*a* against the wall of collecting pan 26 opening a path for tobacco to flow to pneumatic tube 18*a*. Air operated cylinder 20*b* is shown retracted half way so that control flap 22*b* is positioned to block tobacco flow to pneumatic tube 18*d* while allowing tobacco to flow to pneumatic tube 18*c*.

It will be understood that the foregoing description is of the preferred embodiment of the invention and is, therefore, merely representative. Obviously, there are many variations and modifications of the present invention in light of the above teachings that will be readily apparent to those skilled in the art. For example, the number of cigarette makers supplied could be increased or decreased by varying the number of pneumatic tubes taking a suction on the collecting pan and by varying the number of control flaps positioned in the collecting pan and changing the number of speeds on the variable speed conveyor belt. It is, therefore, understood that within the scope of the appended claims the invention may be practiced otherwise than is specifically described.

I claim:

1. An automatic tobacco feeder for pneumatically conveying tobacco from a storage area to cigarette making machines, said feeder comprising;

a metering tube;

a conveyor belt on which tobacco from said metering tube is deposited;

a collecting pan which receives tobacco from said conveyor;

vacuum tubes located above said collecting pan for removing tobacco from said collecting pan for transport to cigarette making machines; and control flaps for directing the flow of the tobacco to one or more of said vacuum tubes.

2. A tobacco feeder as in claim 1 wherein said collecting pan vibrates to improve the flow of the tobacco.

3. A tobacco feeder as in claim 1 wherein said control flaps are operated by air operated cylinders.

4. A tobacco feeder as in claim 1 wherein said conveyor belt is a variable speed conveyor belt.

5. A tobacco feeder as in claim 1 wherein said collecting pan has inclined portion for decreasing the density of the tobacco stream.

* * * * *